US007623822B2

(12) United States Patent
Matsuno

(10) Patent No.: US 7,623,822 B2
(45) Date of Patent: Nov. 24, 2009

(54) IMAGE FORMING APPARATUS HAVING CONTROL OF TRANSPORTATION UNIT FANS ACCORDING TO SHEET WIDTH

(75) Inventor: Akinori Matsuno, Osaka (JP)

(73) Assignee: Kyocera Mita Corporation, Osaka (JP)

( * ) Notice: Subject to any disclaimer, the term of this patent is extended or adjusted under 35 U.S.C. 154(b) by 494 days.

(21) Appl. No.: 11/653,934

(22) Filed: Jan. 17, 2007

(65) Prior Publication Data

US 2007/0189798 A1 Aug. 16, 2007

(30) Foreign Application Priority Data

Feb. 15, 2006 (JP) ..... 2006-037355

(51) Int. Cl.
*G03G 15/00* (2006.01)
*G03G 21/20* (2006.01)

(52) U.S. Cl. ..... 399/400; 271/197; 399/92

(58) Field of Classification Search ..... 399/43, 399/44, 68, 92, 322, 400, 401; 271/195, 271/197

See application file for complete search history.

(56) References Cited

U.S. PATENT DOCUMENTS 4,286,863 A * 9/1981 Cornwall et al. ..... 399/339
4,493,548 A * 1/1985 Ateya ..... 399/400
4,963,942 A * 10/1990 Aoki ..... 399/335
5,467,180 A * 11/1995 Malachowski et al. ..... 399/381
5,506,670 A * 4/1996 Hatano ..... 399/82
5,550,621 A * 8/1996 Ogawahara ..... 399/69
5,625,444 A * 4/1997 Suzuki et al. ..... 399/400
6,539,185 B2 * 3/2003 Hanyu et al. ..... 399/67
6,873,821 B2 * 3/2005 Russel et al. ..... 399/400
7,466,934 B2 * 12/2008 Chae et al. ..... 399/69

FOREIGN PATENT DOCUMENTS

JP 57181563 A * 11/1982
JP 59043752 A * 3/1984
JP 01104560 A * 4/1989
JP 05017044 A * 1/1993
JP 5-181382 7/1993
JP 06239490 A * 8/1994
JP 9-146309 6/1997

* cited by examiner

*Primary Examiner*—Robert Beatty
(74) *Attorney, Agent, or Firm*—Smith, Gambrell & Russell, LLP

(57) ABSTRACT

Assume that a paper feed width of a sheet of paper of a predetermined size that is smaller than the maximum paper feed width W is W1. Then, when a sheet of paper having a width larger than the paper feed width W1 is transported, to stabilize the transportation thereof, first, second, and third fans 26*a* to 26*c* are all so rotated as to stick the entire sheet of paper to a transportation unit 25. On the other hand, when a sheet of paper having a width equal to or smaller than the paper feed width W1 is transported, only the first and third fans 26*a* and 26*c* are made to rotate to prevent an increase in the temperature of non-paper feeding areas 30*a* and 30*b* formed at the edges of a fuser roller pair 14*a*.

12 Claims, 8 Drawing Sheets

IMAGE FORMING APPARATUS HAVING CONTROL OF TRANSPORTATION UNIT FANS ACCORDING TO SHEET WIDTH

This application is based on Japanese Patent Application No. 2006-037355 filed on Feb. 15, 2006, the contents of which are hereby incorporated by reference.

BACKGROUND OF THE INVENTION

1. Field of the Invention

The present invention relates to an image forming apparatus, such as a copier or a printer, having a duplexer that is capable of duplex printing, and more particularly to a cooling mechanism for cooling a non-paper feeding part of a fuser roller pair.

2. Description of Related Art

A schematic configuration of a conventional image forming apparatus is shown in FIG. 10. In FIG. 10, reference numeral 100 represents an image forming apparatus. Here, a digital multifunction apparatus will be described as an example of the image forming apparatus. Assume that a copy operation is performed with the image forming apparatus 100. Then, in an image forming portion 3 provided inside the multifunction apparatus body 2, a small diameter photoconductive drum 5 rotating in a direction indicated by arrow A shown in the figure is uniformly charged by a charging unit 4, then an electrostatic latent image is formed on a photoconductive drum 5 with a laser beam emitted from an exposure unit (a laser scanning unit, or the like) 7 based on original image data read by an image reader 6, and then developer (hereinafter, toner) is attached to the resultant electrostatic latent image by a developer unit 8. In this way, a toner image is formed. The toner is supplied to the developer unit 8 from a toner container 9.

Toward the photoconductive drum 5 on which the toner image is thus formed, a sheet of paper is transported from a paper feed mechanism 10 to the image forming portion 3 by way of a paper transportation path 11 and a resist roller pair 12. In the image forming portion 3, the toner image formed on the surface of the photoconductive drum 5 is transferred to the sheet of paper by a transfer roller 13 (transfer means). The sheet of paper to which the toner image is transferred is separated from the photoconductive drum 5, and is then transported to a fuser 14 having a fuser roller pair 14*a*, where the toner image is fused to the sheet of paper. The sheet of paper that has passed through the fuser 14 is sent to a multi-branched paper transportation path 15, where path switch mechanisms 21 and 22 provided at branching points thereof and each having a plurality of path switch guides determine in which direction the sheet of paper is transported. Then, the sheet of paper is directly (or, after having been sent to a duplex-printing paper transportation path 16 to perform a two-sided copy) ejected onto a paper catch portion of a first output tray 17*a* or a second output tray 17*b* through an output roller pair 20*a* or 20*b*.

Though not shown in the figure, a discharger for removing charge remaining on the surface of the photoconductive drum 5 is disposed at a downstream side of a cleaner 18 along the photoconductive drum 5. Furthermore, the paper feed mechanism 10 is detachably attached to the multifunction apparatus body 2, and is composed of a plurality of paper feed cassettes 10*a* and 10*b* that hold sheets of paper, and a stack bypass (a manual feed tray) 10*c*. The plurality of paper feed cassettes 10*a* and 10*b* and the stack bypass 10*c* are connected by way of the paper transportation path 11 to the image forming portion 3 built with the photoconductive drum 5, the developer unit 8, and the like. Reference numeral 24 represents a platen (a document retainer) that retains a document placed on the image reader 6.

Specifically, at a downstream side of the fuser roller pair 14*a*, the paper transportation path 11 first forks into two paths, of which one (in FIG. 10, a rightward path) is connected to the first output tray 17*a* via the output roller pair 20*a*, and the other (in FIG. 10, a leftward path) further branches into two paths, of which one is made to eject a sheet of paper into the second output tray 17*b* via the output roller pair 20*b* and the other is connected to the duplex-printing paper transportation path 16. Incidentally, the duplex-printing paper transportation path 16 is a path along which a sheet of paper having an image on one side thereof is switched back and then transported. After image formation is repeated by the image forming portion 3 on the other side of the sheet of paper thus transported, the resultant sheet of paper is ejected (a two-sided copy is made).

In such an image forming apparatus, the fuser roller pair 14*a* needs to have a uniform temperature distribution so that the fuser 14 can stably fuse a toner image. However, when a sheet of paper passes through the fuser roller pair 14*a*, the fuser roller pair 14*a* is deprived of heat where it makes contact with the sheet of paper (a paper feeding area). This causes accumulation of heat in the area of the fuser roller pair 14*a* where the sheet of paper does not pass thorough (a non-paper feeding area) because the fuser roller pair 14*a* is not deprived of heat in a non-paper feeding area.

FIG. 11 shows how the fusing temperatures of a paper feeding area and a non-paper feeding area change when printing is continuously performed on sheets of paper whose width is smaller than the maximum width of the fuser roller pair. Here, as an example of implementation, a description will be given of a case where A5 sheets of paper are continuously fed to the apparatus. At the start of continuous printing, the temperature of a paper feeding area (indicated by a heavy line in the figure) is set around 200° C., and the temperature of a non-paper feeding area (indicated by a thin line in the figure) is around 185° C., which is slightly lower than that of the paper feeding area, due to the arrangement of heat sources inside the rollers, the influence of outside air, or the like.

When 50 seconds have elapsed after the start of continuous printing, the temperature of the paper feeding area drops to about 175° C. due to the contact of the sheets of paper. To prevent poor fusing resulting from this temperature drop, the output of the heat sources is increased, causing gradual increase in the temperature of the paper feeding area. However, since the non-paper feeding area is not deprived of heat by the paper, the temperature thereof rises more sharply than that of the paper feeding area. As a result, when 300 seconds have elapsed, the temperature of the non-paper feeding area is more than 20° C. higher than that of the paper feeding area.

When the continuous feeding of paper is temporarily stopped after a lapse of about 330 seconds, the temperature of the paper feeding area rises again to around 200° C. This reduces the difference between the temperatures of the paper feeding area and the non-paper feeding area. However, once the continuous feeding of paper is resumed, the temperature of the paper feeding area drops again for the reason mentioned above. Inconveniently, repeating this cycle causes unnecessary rise in the temperature of the non-paper feeding area and shortens the life of the fuser roller pair. On the other hand, if the temperature of the fuser roller pair is as a whole reduced with an increase in the temperature of the non-paper feeding area, the temperature of the paper feeding area is also reduced. This makes it impossible to supply to a sheet of paper the amount of heat required to fuse an image thereto.

To overcome these inconveniences, proposals have conventionally been made to prevent an increase in the temperature of a non-paper feeding area by cooling a part of a fuser roller pair corresponding to a non-paper feeding area. JP-A-05-181382 discloses an image forming apparatus provided with a cooling fan that, when more than a predetermined number of transfer materials having a set width smaller than the maximum width transportable by a rotating member (a fuser roller pair) in the axis direction thereof are transported within a predetermined time, blows cooling air onto a non-paper feeding area where the transfer material having the set width does not pass through, and a guide device (a duct) that guides the cooling air.

However, according to the method disclosed in JP-A-05-181382, blowing of air from the cooling fan is controlled by opening and closing the window provided near the non-paper feeding area of the fuser roller pair. This undesirably complicates the structure around the fuser. Besides, there is a need to make room for a duct around the fuser roller pair, making it impossible to achieve a space-saving image forming apparatus.

Moreover, the following problem arises when a large-sized sheet of paper is transported. The large-sized paper is easily wrinkled during transportation, often resulting in distortion of an unfused toner image formed on the paper. Furthermore, as shown in FIG. 10, in the case of a duplex-printing image forming apparatus that re-transports, instead of ejecting, a sheet of paper having an image on one side thereof to the image forming means to repeat image formation on the other side thereof, the sheet of paper that has an image on one side thereof and is re-transported inside the apparatus tends to be cooled more slowly than one that is directly ejected from the apparatus. This also slows cooling and hardening of the toner, causing problems such as adhesion between sheets of paper, print dropouts, or smudges at the time of duplex printing.

To overcome these problems, JP-A-09-146309 discloses a duplex-printing image forming apparatus provided with an intermediate tray that reverses a sheet of paper having an image on one side thereof, wherein a sheet of paper to which a toner image has been transferred is transported to a fuser while being stuck to the transportation means by air suction of the fan, and the sheet of paper placed on the intermediate tray is cooled by the air blown thereonto from the fan.

According to the method disclosed in JP-A-09-146309, transportation of a large-sized sheet of paper to which a toner image has been transferred can be stabilized by air suction of the fan, and the fan used for stabilizing the transportation of the paper can be shared as the fan used for cooling the paper at the time of duplex printing. This helps reduce adhesion between the sheets of papers, print dropouts, or smudges at the time of duplex printing. This also makes it possible to reduce the number of fans, and thereby achieve a reduction in noise as well as in cost. However, since the image forming apparatus disclosed in this Patent Document does not have the function of cooling a non-paper feeding area of a fuser roller pair, it is impossible to prolong the life of the fuser roller pair.

SUMMARY OF THE INVENTION

In view of the conventionally experienced problems described above, it is an object of the present invention to provide an image forming apparatus that can prevent an increase in the temperature of a non-paper feeding area of a fuser roller pair when a small-sized sheet of paper is transported, that can stabilize transportation of a large-sized sheet of paper, and that can be produced at low costs.

To achieve the above object, according to the present invention, an image forming apparatus is provided with: a transportation unit that has transfer means transferring a toner image formed on an image carrier to a recording medium, and that carries and transports the recording medium; a fuser that fuses the toner image transferred by the transfer means to the recording medium; a plurality of fans that are provided across a transportation width of the transportation unit for sticking the recording medium on the transportation unit onto a transporting surface by depressurizing; an air guide path through which an air inflow side of each fan communicates with the inside of the fuser; and control means that controls the rotation of the fans in such a way that, when more than a predetermined number of recording mediums having a width equal to or smaller than a predetermined width are transported within a predetermined time, the rotation of the fan communicating through the air guide path with a paper feeding area located inside the fuser and the rotation of the fan communicating through the air guide path with a non-paper feeding area located inside the fuser are separately controlled.

With this structure, the transportation of a large-sized recording medium is stabilized, and, when more than a predetermined number of recording mediums of a size equal to or smaller than a predetermined size are transported within a predetermined time, hot air near the non-paper feeding area inside the fuser is sucked in by the fans through the air guide path, whereby the part of the fuser roller pair located inside the fuser corresponding to the non-paper feeding area is cooled. This makes it possible to prevent an increase in the temperature of the non-paper feeding area and thus even out the surface temperature of the fuser roller pair in the axis direction.

According to the present invention, in the image forming apparatus structured as described above, when more than a predetermined number of recording mediums having a width equal to or smaller than the predetermined width are transported within a predetermined time, the control means rotates only the fan communicating with the non-paper feeding area located inside the fuser.

With this structure, it is possible to cool the non-paper feeding area more effectively.

According to the present invention, in the image forming apparatus structured as described above, when more than a predetermined number of recording mediums having a width equal to or smaller than the predetermined width are transported within a predetermined time, the control means makes the rotation speed of the fan communicating with the paper feeding area located inside the fuser slower than the rotation speed of the fan communicating with the non-paper feeding area.

With this structure, it is possible to stabilize the transportation of a small-sized recording medium and prevent the surface temperature of the fuser roller pair from varying.

According to the present invention, in the image forming apparatus structured as described above, there is provided opening/closing means that opens/closes the air guide path, and when a recording medium that is wider than the predetermined width is transported, the control means causes the opening/closing means to close the air guide path.

With this structure, when a large-sized recording medium is transported, suction of hot air inside the fuser by the rotation of the fan is stopped. This makes it possible to prevent a reduction in the surface temperature of the fuser roller pair.

According to the present invention, in the image forming apparatus structured as described above, there is provided a duplex-printing paper transportation path that re-transports to the transfer means a recording medium that has passed through the fuser at the time of duplex printing, and an air outflow side of each fan communicates with the duplex-printing paper transportation path.

With this structure, air from the fan is blown out to the duplex-printing paper transportation path side, and can be used for cooling and drying a recording medium passing through the duplex-printing paper transportation path and for stabilizing the transportation thereof.

DETAILED DESCRIPTION OF PREFERRED EMBODIMENTS

Figure 1:
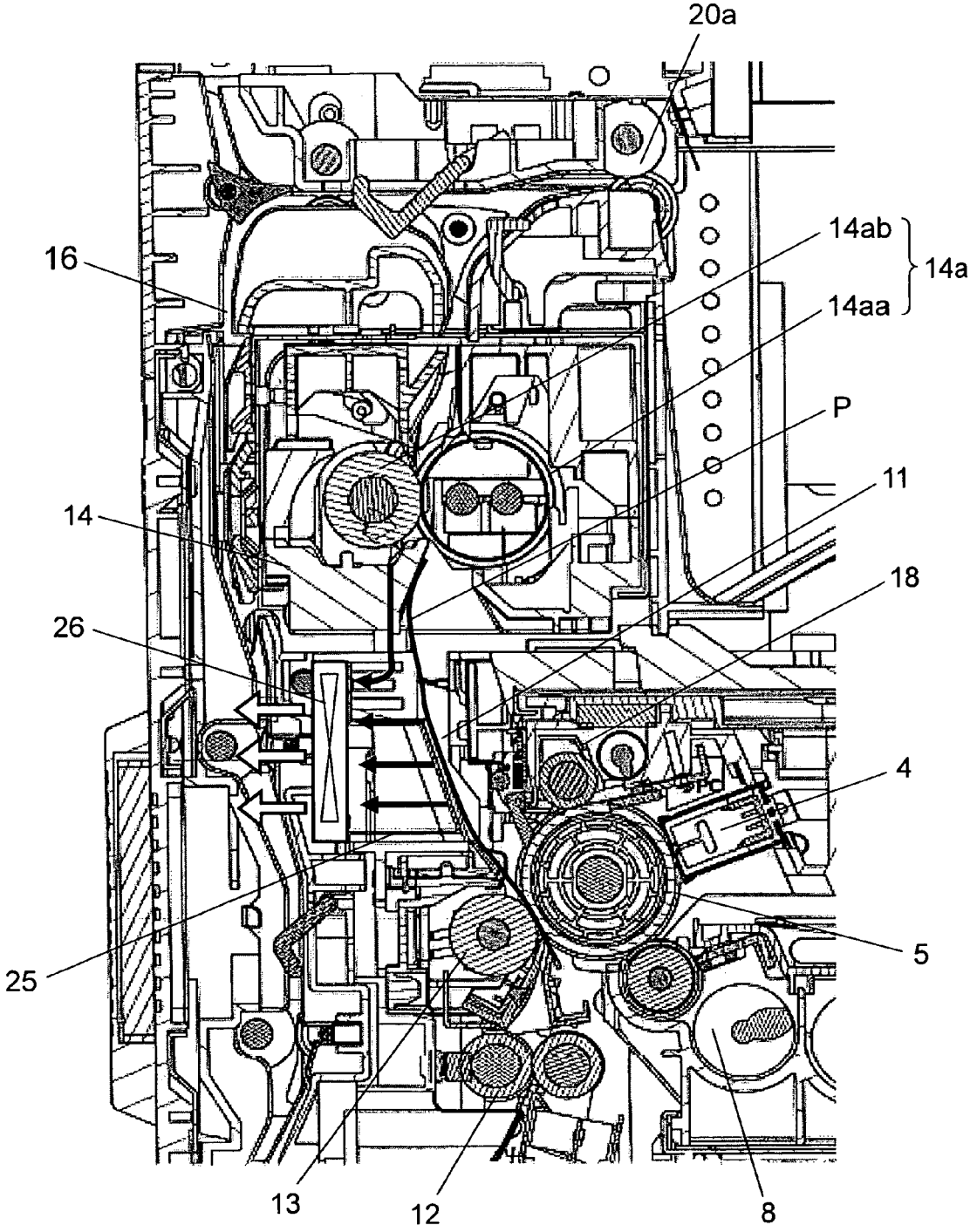
FIG. 1 is a partially sectional view showing the structure near the image forming portion and the fuser of the image forming apparatus according to one embodiment of the present invention.
Figure 10:
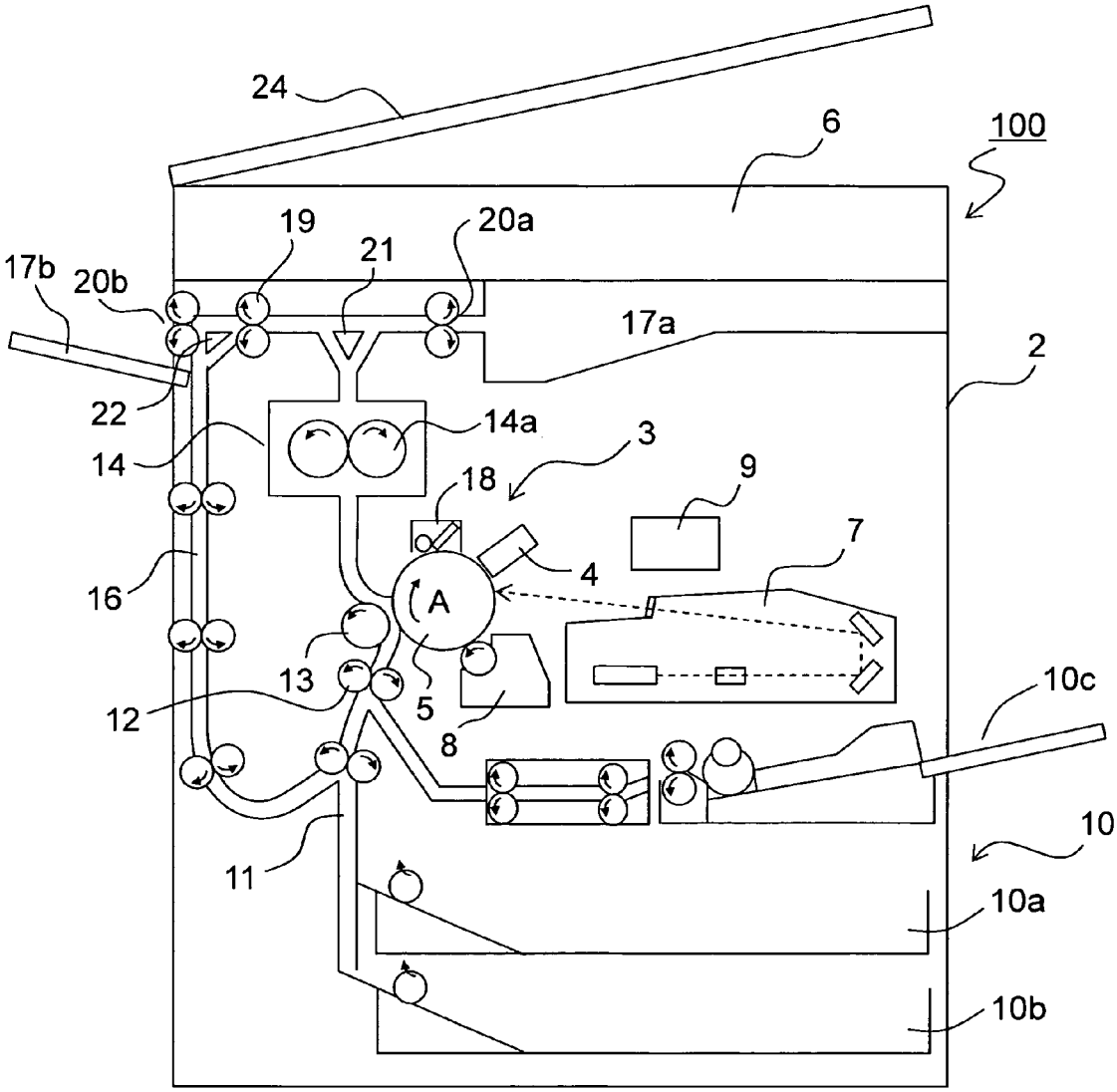
FIG. 10 is a schematic diagram showing the entire structure of a conventional image forming apparatus.
Figure 11:
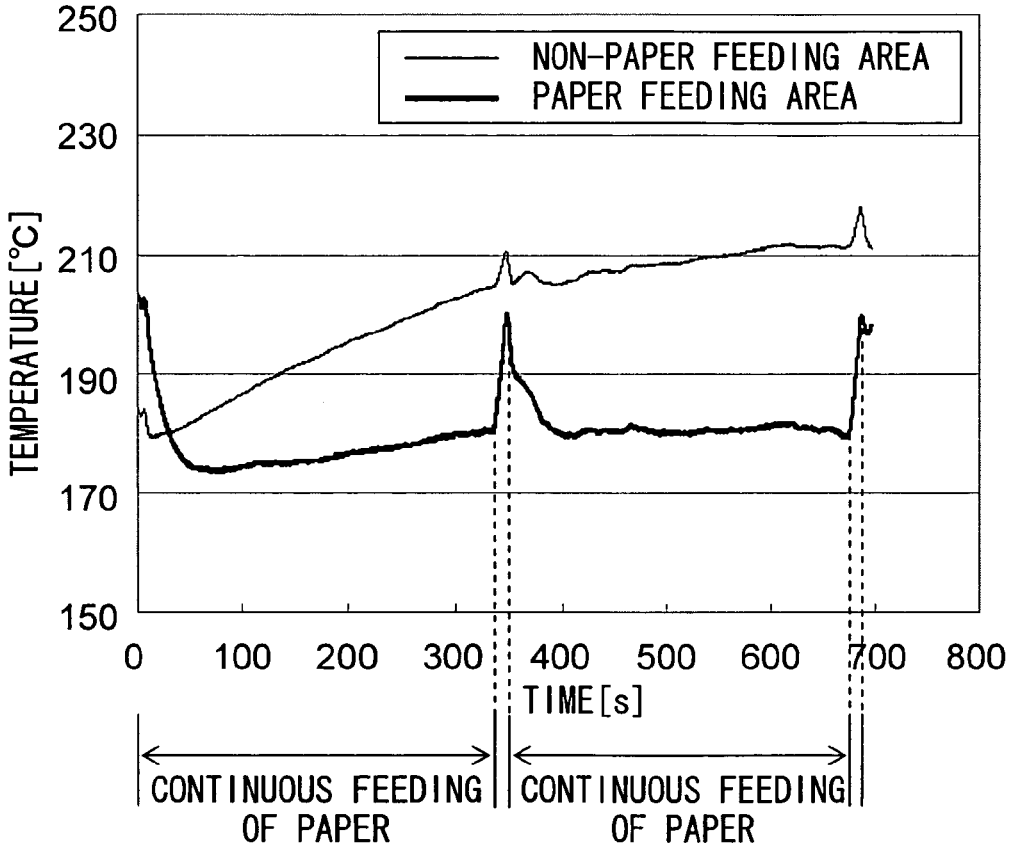
FIG. 11 is a graph showing how the fusing temperatures of a paper feeding area and a non-paper feeding area change when printing is continuously performed.

Hereinafter, an embodiment of the present invention will be described with reference to the accompanying drawings. FIG. 1 is a partially sectional view showing the structure near the image forming portion and the fuser of the image forming apparatus according to one embodiment of the present invention. It is to be noted that such members as are found also in the conventional example shown in FIG. 10 are identified with the same reference numerals, and their explanations will not be repeated. As shown in FIG. 1, a fuser 14 houses a fuser roller pair 14*a* composed of a heating roller 14*aa* inside which a heater is placed and a pressure roller 14*ab*. When a sheet of paper (recording medium) P to which a toner image is transferred by a photoconductive drum 5 and a transfer roller 13 passes through a nip portion of the fuser roller pair 14*a*, the toner image is fused to the sheet of paper P.

Reference numeral 25 represents a transportation unit constituting a part (one of the transporting surfaces) of a paper transportation path 11, and there are arranged a resist roller pair 12, a transfer roller 13, and the like. Fans 26 are placed in the transportation unit 25, and a sheet of paper P that has passed through the transfer roller 13 is stuck to the transportation unit 25 side by depressurizing by suction air (indicated by black arrows shown in the figure) of the fans 26. Through an air guide path (which will be described later) provided in the fuser 14, an air inflow side of each fan 26 (the side thereof lying at the right side of the figure) communicates with the inside of the fuser 14, whereby heat inside the fuser 14 is released to the outside. Air from the fans 26 (indicated by white arrows shown in the figure) is blown out to the duplex-printing paper transportation path 16 side.

Figure 2:
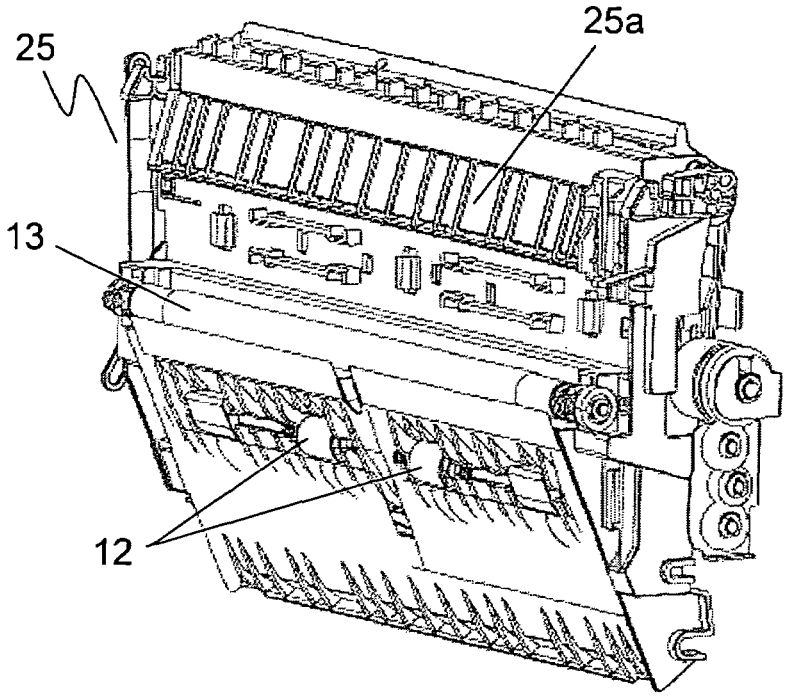
FIG. 2 is a perspective view, as seen from the paper transportation path side (the right of FIG. 1), of the transportation unit.
Figure 3:
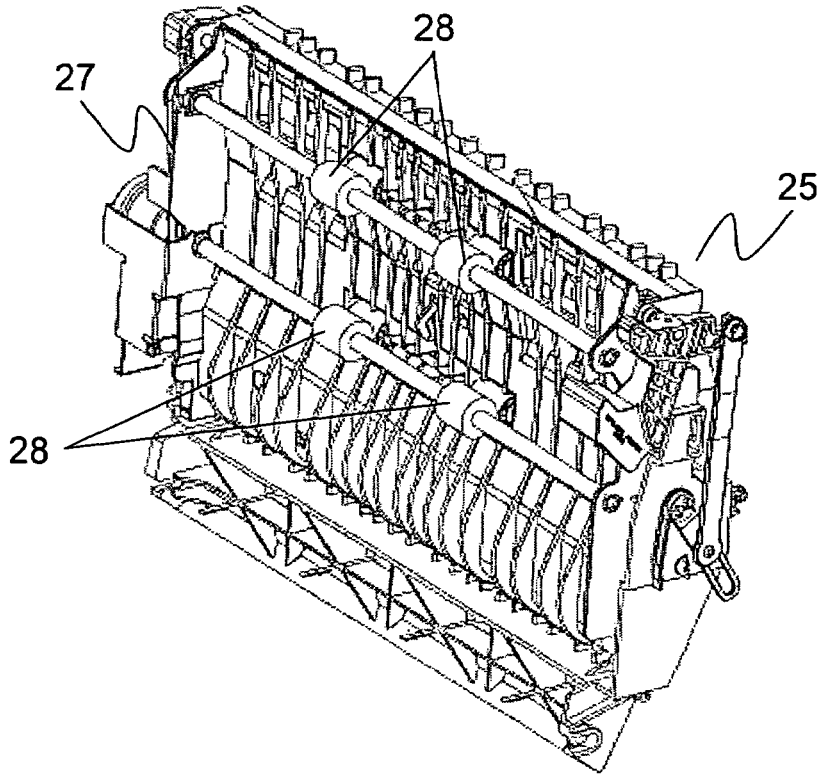
FIG. 3 is a perspective view, as seen from the duplex-printing paper transportation path side (the left of FIG. 1), of the transportation unit.

FIG. 2 is a perspective view, as seen from the paper transportation path side (the right of FIG. 1), of the transportation unit 25, and FIG. 3 is a perspective view, as seen from the duplex-printing paper transportation path 16 side (the left of FIG. 1), of the transportation unit 25. On the paper transportation path 11 side of the transportation unit 25, the resist roller pair 12 and the transfer roller 13 are placed. Behind the transportation unit 25 (on the duplex-printing paper transportation path 16 side thereof), a duplexer 27 having a plurality of transportation rollers 28 and constituting a part of the duplex-printing paper transportation path 16 is mounted. Formed on the surface of the transportation unit 25 are suction air slits 25*a* through which suction air of the fans 26 (see FIG. 1) passes, whereby a piece of paper is stuck to the transportation unit 25 side and is smoothly transported along the transportation unit 25.

Figure 4:
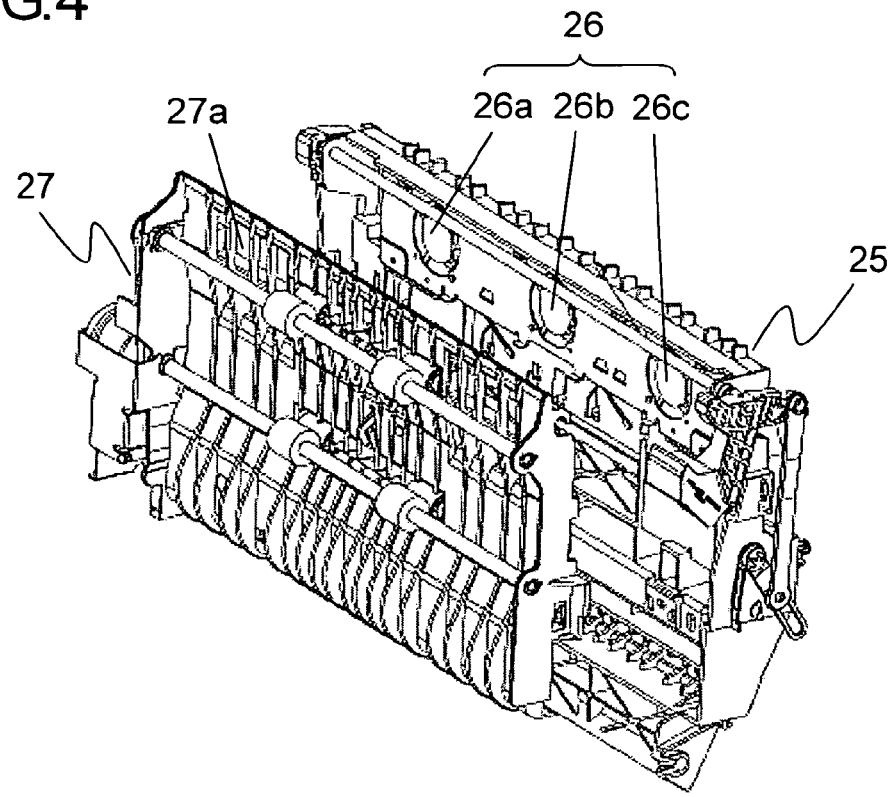
FIG. 4 is a perspective view showing a state in which the transportation unit and the duplexer are separated from each other.

FIG. 4 is a perspective view showing a state in which the transportation unit 25 and the duplexer 27 are separated from each other. The fans 26 include a first fan 26*a*, a second fan 26*b*, and a third fan 26*c*, each being provided in a direction (a paper width direction) perpendicular to the direction in which the sheet of paper is transported. The duplexer 27 has formed therein air outflow slits 27*a* through which air outflow sides of the fans 26*a* to 26*c* communicate with the duplex-printing paper transportation path 16.

Figure 5:
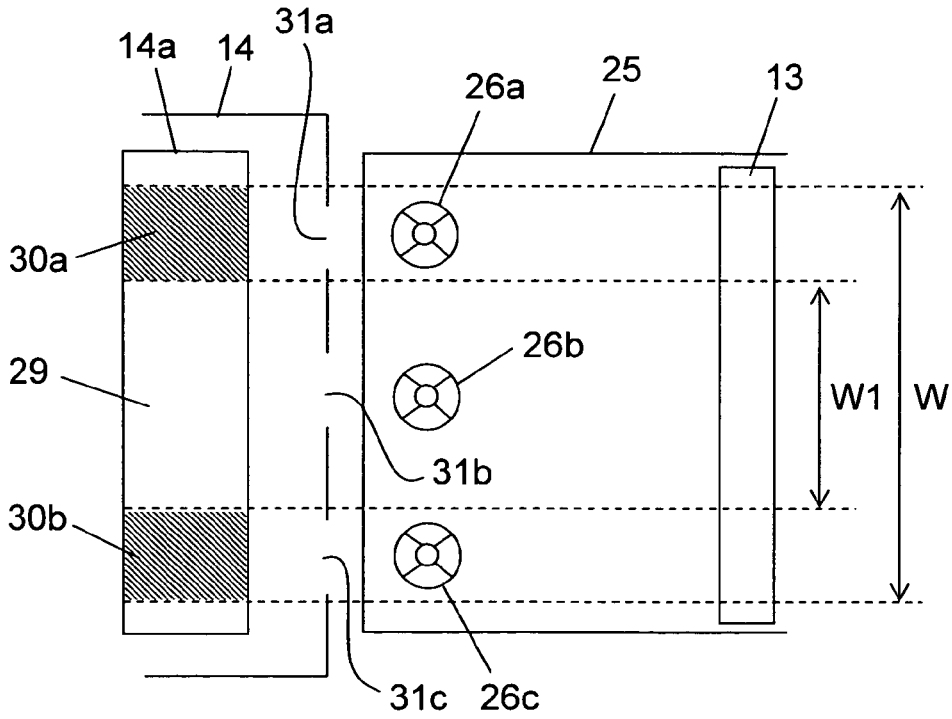
FIG. 5 is a schematic plan view showing the positional relationship between the fans and the fuser.

FIG. 5 is a schematic plan view showing the positional relationship between the fans 26 and the fuser 14. A distinctive feature of the present invention is that a plurality of fans 26 (in the figure, three of them) used for stabilizing the transportation of a sheet of paper are provided across the transportation width of the transportation unit 25, and the rotation of these fans 26*a* to 26*c* are individually controlled in accordance with the size and number of sheets of paper to be transported. That is, assume that a maximum paper feed width is W, and a paper feed width of a sheet of paper of a predetermined size that is smaller than the maximum paper feed width W is W1. Then, when a sheet of paper having a width larger than the paper feed width W1 is transported, in order to stabilize the transportation thereof, the first, second, and third fans 26*a* to 26*c* are all so rotated as to stick the entire sheet of paper to the transportation unit 25.

On the other hand, the following problem arises when sheets of paper having a width equal to or smaller than the paper feed width W1 are continuously transported. The sheets of paper make contact only with a paper feeding area 29 located at the center of the fuser roller pair 14*a*, depriving the paper feeding area 29 of heat and reducing the surface temperature of the paper feeding area 29. To avoid this, the temperature of the heater placed inside the heating roller 14*aa* is so controlled as to prevent the temperature of the paper feeding area 29 from dropping below a predetermined temperature, and only the first fan 26*a* and the third fan 26*c* are made to rotate while stopping the rotation of the second fan 26*b* to prevent an increase in the temperature of non-paper feeding areas 30*a* and 30*b* formed at the edges of the fuser roller pair 14*a*. This causes hot air near the non-paper feeding areas 30*a* and 30*b* to be sucked in by the first fan 26*a* and the third fan 26*c* through air guide paths 31*a* and 31*c* formed in the housing of the fuser 14, whereby the parts corresponding to the non-paper feeding areas 30*a* and 30*b* are cooled. This makes it possible to even out the surface temperature of the fuser roller pair 14*a* in the axis direction.

Incidentally, since the rotation of the second fan 26*b* is stopped when a sheet of paper having a width equal to or smaller than the paper feed width W1 is being transported, the sheet of paper is not forcedly stuck to the transportation unit 25. This, however, produces no problem since a small-sized sheet of paper is less likely to be wrinkled compared with a large-sized one during transportation, and thus can be transported stably without the help of suction power of the fan.

Figure 6:
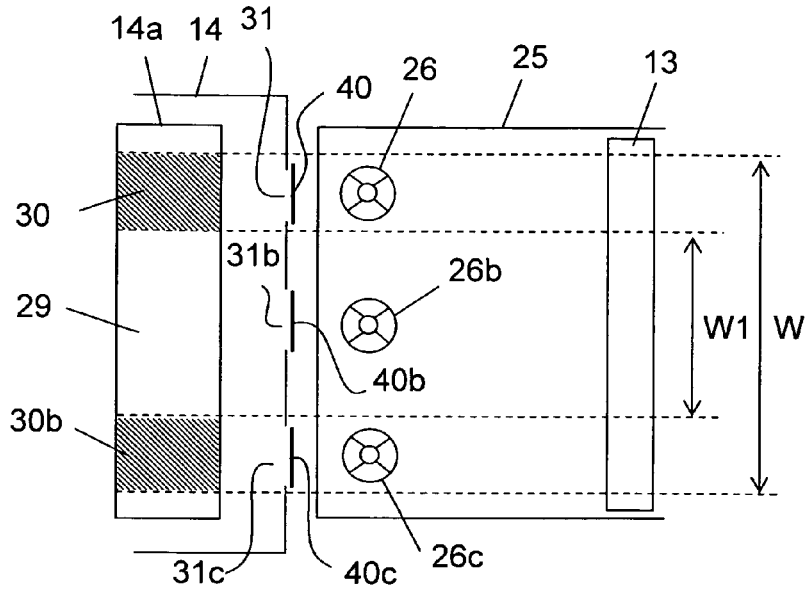
FIG. 6 is a schematic plan view showing an example in which the shutter mechanisms are provided in the air guide paths.

Moreover, when a sheet of paper having a width larger than the paper feed width W1 is transported, the sheet of paper makes contact with almost the entire area of the fuser roller pair 14*a*, and hot air inside the fuser 14 is uniformly sucked in by the fans 26*a* to 26*c*. This eliminates the possibility that the surface temperature of the fuser roller pair 14*a* varies. It is to be noted that, as shown in FIG. 6, shutter mechanisms 40*a* to 40*c* that can be opened and closed may be provided in the air guide paths 31*a* to 31*c* respectively, so that, when a sheet of paper having a width larger than the paper feed width W1 is transported, the air guide paths 31*a* to 31*c* are closed so as to prevent a reduction in the surface temperature of the fuser roller pair 14*a* resulting from the rotation of the fans 26*a* to 26*c*.

The air from the fans 26*a* to 26*c* is blown out through the air outflow slits 27*a* (see FIG. 4) of the duplexer 27 onto the sheet of paper passing through the duplex-printing paper transportation path 16 (see FIG. 1). This makes it possible to effectively cool the sheet of paper whose temperature is elevated after passing through the fuser 14 and dry the toner image, and helps reduce occurrence, at the time of duplex printing, of transportation failure due to adhesion between the sheets of papers or poor quality images such as print dropouts or smudges. Furthermore, this prevents the sheet of paper from being separated from the transporting surface inside the duplex-printing paper transportation path 16, thereby maintaining a stable transportation thereof.

Although the descriptions heretofore deal with a case in which three fans, i.e. the first to third fans 26*a* to 26*c*, are provided along the direction of the transportation width, it is also possible to provide four or more fans and air guide paths corresponding thereto, and perform control of the fans so as to rotate or stop them in accordance with the size of the non-paper feeding areas 30*a* and 30*b* that varies with the size of the paper in the width direction. This further ensures a uniform surface temperature of the fuser roller pair 14*a*. Moreover, to make the fans 26*a* to 26*c* generate further effective air flow, there may be provided ducts between the air guide paths 31*a* to 31*c* and the fans 26*a* to 26*c*.

Figure 7:
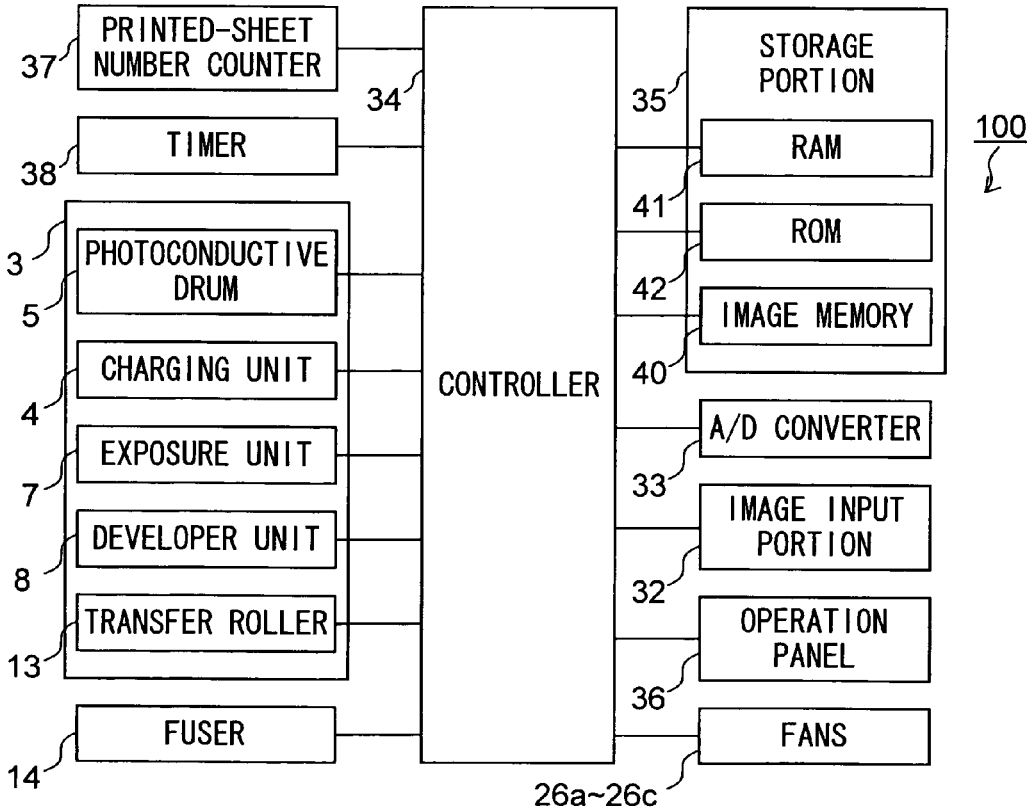
FIG. 7 is a block diagram showing the control mechanism of the image forming apparatus of the present invention.

FIG. 7 is a block diagram showing the control mechanism of the image forming apparatus of the present invention. It is to be noted that such members as are found also in the conventional example shown in FIG. 10 are identified with the same reference numerals, and their explanations will not be repeated. The image forming apparatus 100 is composed of an image forming portion 3, an image input portion 32, an A/D converter 33, a controller 34, a storage portion 35, an operation panel 36, a printed-sheet number counter 37, a timer 38, and the like.

In a case where the image forming apparatus 100 is a copier as shown in FIG. 10, the image input portion 32 serves as an image reader 6 (see FIG. 10) composed of a scanning optical system provided with a scanner lamp that illuminates a document when making a copy thereof and a mirror that changes an optical path of light reflected from the document, a condenser lens that condenses light reflected from the document and then forms an optical image, a CCD that converts image light thus formed into an electrical signal, and the like. In a case where the image forming apparatus 100 is a printer, the image input portion 32 serves as a receiver that receives image data transmitted from a personal computer or the like. An image signal inputted by the image input portion 32 is sent to a controller 34, and is then subjected to image processing such as tone processing as appropriate. The resultant image signal is then converted into a digital signal by the A/D converter 33, and is then sent to an image memory 40 provided inside the storage portion 35, which will be described later.

The image forming portion 3 is composed of a photoconductive drum 5, a charging unit 4, an exposure unit 7, a developer unit 8, a transfer roller 13, and the like. Based on the image data that has been converted by the A/D converter 33 and then stored in the image memory 40, the image forming portion 3 forms an electrostatic latent image on the photoconductive drum 5. The components such as the photoconductive drum 5, the transfer roller 13, the fuser roller pair 14*a* (see FIG. 1) provided inside the fuser 14 are rotated by a main motor (not shown). The controller 34 transmits a control signal to the main motor for performing control of the photoconductive drum 5, the transfer roller 13, the fuser roller pair 14*a*, and the like, so as to rotate or stop them.

The controller 34 performs overall control of the image input portion 32, the image forming portion 3, the fuser 14, and the like, according to a set program, and converts the image signal inputted from the image input portion 32 into image data by carrying out scaling processing or tone processing as necessary. Based on the image data thus processed, the exposure unit 7 emits laser light and forms a latent image on the photoconductive drum 5. Furthermore, according to the set program, the controller 34 performs control of individual components of the image forming apparatus, such as the image input portion 32, the charging unit 4, the exposure unit 7, and the developer unit 8.

The storage portion 35 is provided with the image memory 40, a RAM 41, and a ROM 42. The image memory 40 stores an image signal that has been inputted by the image input portion 32 and then digitally-converted by the A/D converter 33, and sends it to the controller 34. The RAM 41 and the ROM 42 store, for example, an image processing program for the controller 34 and details of processing performed by the controller 34, and also store a control program (which will be described below) for the fans 26*a* to 26*c* commensurate with the size and number of sheets of paper to be printed.

The operation panel 36 is composed of an operation portion (unillustrated) built with a plurality of operation keys and a display portion (unillustrated) that indicates settings, apparatus status conditions, or the like. The operation panel 36 allows the user to make settings such as printing conditions. Besides, in a case where the image forming apparatus 100 serves also as a facsimile, for example, the operation panel 36 is used for registering facsimile destinations in the storage portion 35 and making various settings such as reading or rewriting the registered facsimile destinations. The printed-sheet number counter 37 adds up the number of printed sheets of paper passing through the image forming portion 3 with respect to each paper size, and the timer 38 counts the time that has elapsed since the start of printing. The values thus obtained are stored in the storage portion 35, and are used by the controller 34 in controlling the fans 26*a* to 26*c*.

Figure 8:
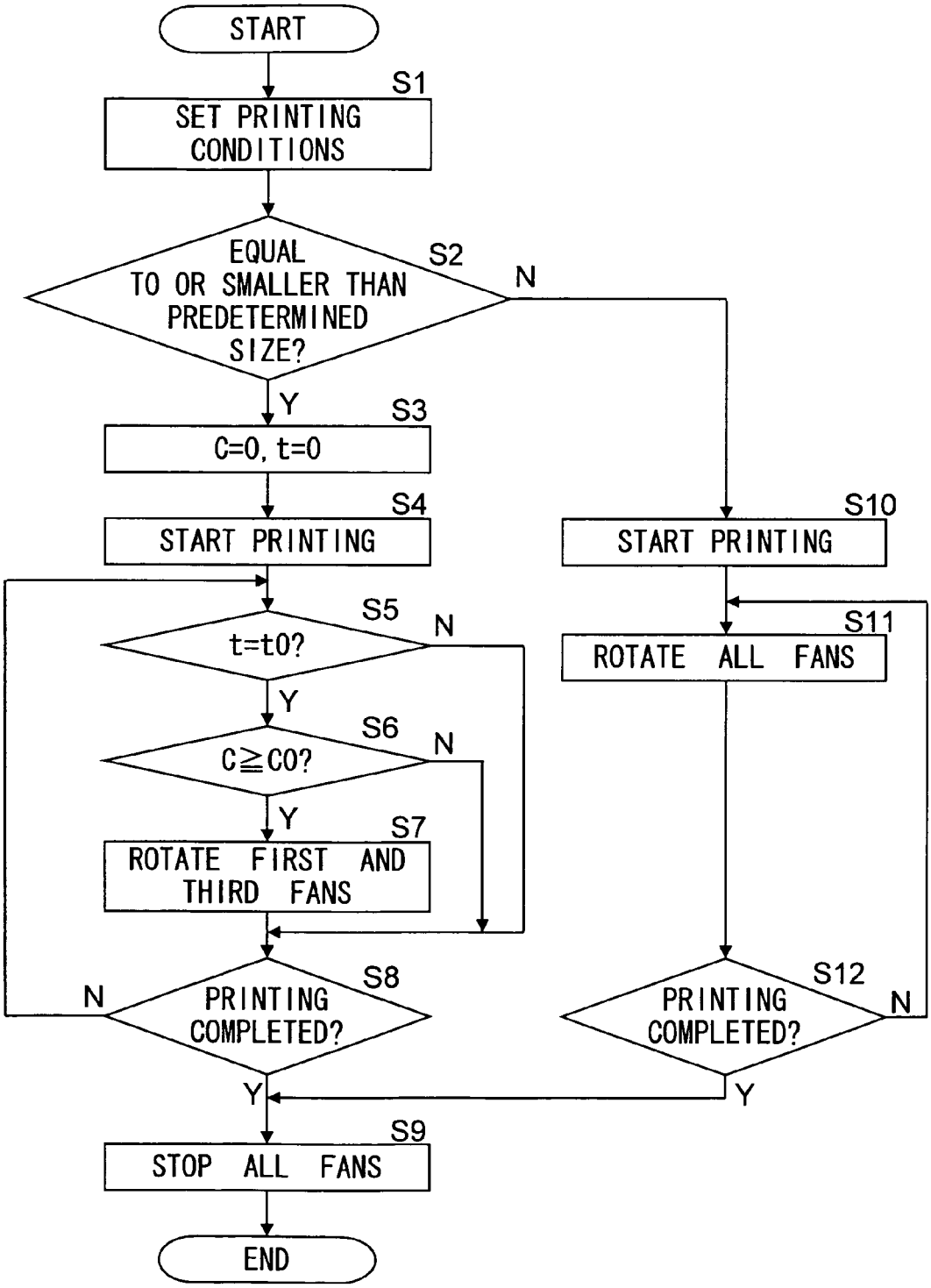
FIG. 8 is a flow chart showing an example of the procedure performed during image formation for controlling the driving of the fans.

FIG. 8 is a flow chart showing an example of the procedure performed during image formation for controlling the driving of the fans. With reference to FIGS. 5 and 7, cooling control for the non-paper feeding area of the fuser roller pair 14*a* will be described in accordance with the steps shown in FIG. 8. First, printing conditions such as the number of sheets of paper to be printed or magnification are manually set by the user's input operation by using the operation panel 36 or a personal computer, and the paper size is manually set by the input operation or automatically set by document reading operation (step S1). Then, a printing start instruction is inputted by turning a start button ON.

Next, the controller 34 judges whether or not the set paper size is equal to or smaller than a predetermined size (step S2). If the set paper size is judged to be equal to or smaller than the predetermined size, count value C of the printed-sheet number counter 37 that counts the number of printed sheets of paper and timer value t of the timer 38 that counts the time that has elapsed since the start of printing are reset to zero (step S3), and printing processing in the image forming portion 3 is started without rotating the fans 26*a* to 26*c* (step S4).

The printed-sheet number counter 37 and the timer 38 are preset to predetermined values C0 and t0, respectively. During printing, it is judged whether or not t=t0 (step S5). If it is judged that t=t0, it is then judged whether or not C≧C0 (step S6). If both t=t0 and C≧C0, this means that C0 or more sheets of paper of a size equal to or smaller than the predetermined size have passed through the fuser roller pair 14*a* within time t0. In this case, the first fan 26*a* and the third fan 26*c* are made to rotate without rotating the second fan 26*b* located at the center in the width direction (step S7), thereby preventing an increase in the temperature of the non-paper feeding areas 30*a* and 30*b*. On the other hand, if it is judged at step S5 that t<t0, or if it is judged at step S5 that t=t0 and then judged at step S6 that C<C0, the controller 34 performs image formation processing without rotating the fans 26*a* to 26*c*.

Then it is judged whether or not printing of a predetermined number of sheets of paper is completed (step S8). If printing is continuously performed, the procedure goes back to step S5 and the same control is performed (steps S5 to S7). If the number of printed sheets of paper reaches the number set at step S1, all the fans 26*a* to 26*c* are stopped (step S9) and the procedure is ended. On the other hand, if the paper size is judged to be larger than the predetermined size at step S2, all the fans 26*a* to 26*c* are made to rotate at the start of printing (steps S10 and S11). Then it is judged whether or not printing of a predetermined number of sheets of paper is completed (step S12). If printing is continuously performed, the procedure goes back to step S11 to continue the processing. If the number of printed sheets of paper reaches the number set at step S1, all the fans 26*a* to 26*c* are stopped (step S9) and the procedure is ended.

Figure 9:
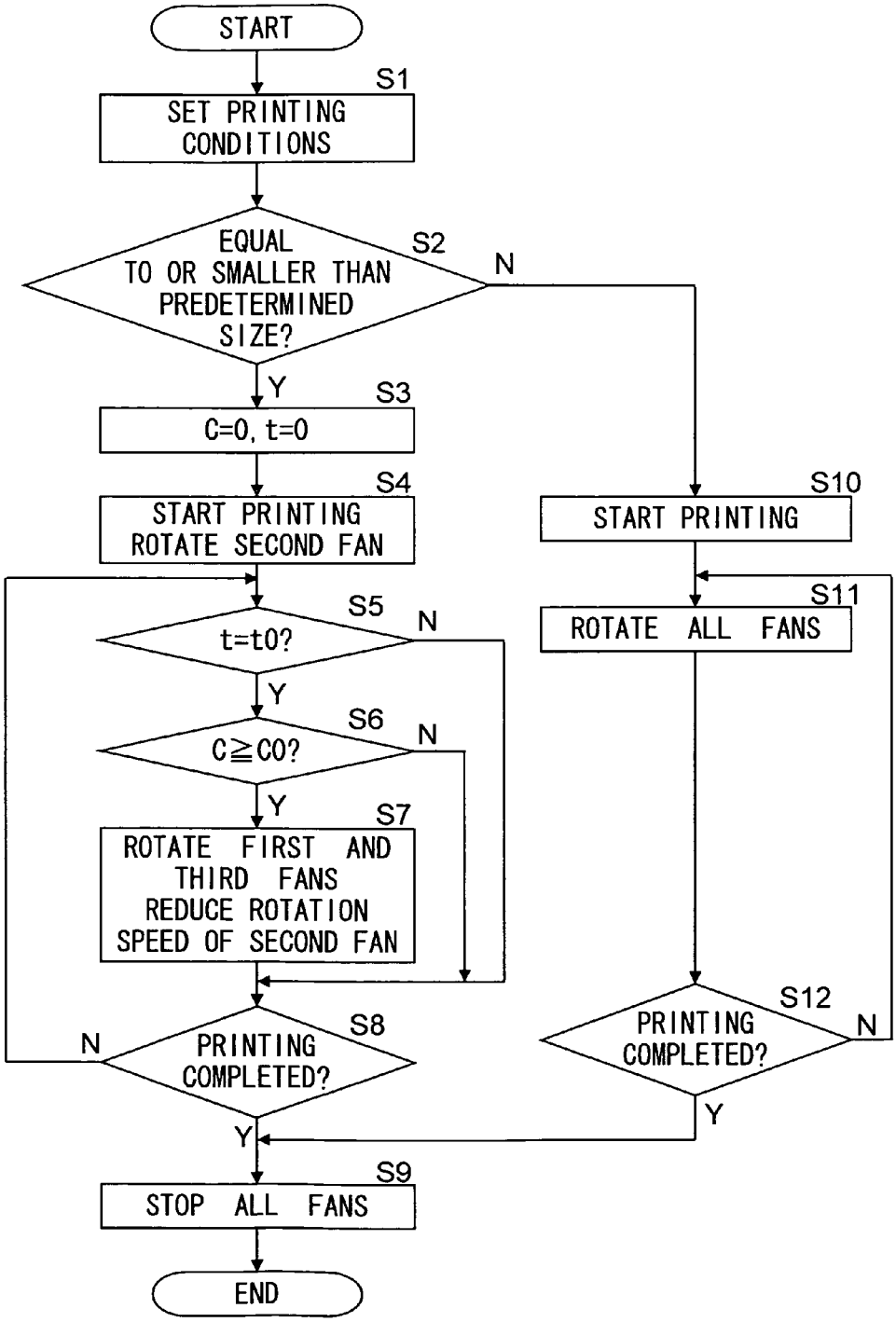
FIG. 9 is a flow chart showing another example of the procedure performed during image formation for controlling the driving of the fans.

FIG. 9 is a flow chart showing another example of the procedure performed during image formation for controlling the driving of the fans. In this example, if the set paper size is judged to be equal to or smaller than the predetermined size at step S2, only the second fan 26*b* is made to rotate at the start of printing (step S4). If both t=t0 and C≧C0, control is so performed as to start rotation of the first fan 26*a* and the third fan 26*c* and reduce the rotation speed of the second fan 26*b* (step S7). Other steps are similar to those of FIG. 8, and therefore their explanations will not be repeated.

With the procedure described above, only the second fan 26*b* communicating with the paper feeding area 29 is made to rotate until the elapsed time t and the number C of printed sheets of paper respectively reach the predetermined values t0 and C0. This allows a sheet of paper of a size equal to or smaller than a predetermined size to be stably transported while being stuck to the transportation unit 25 side. Moreover, after t and C reach the predetermined values, the first and third fans 26*a* and 26*c* are made to rotate and the rotation speed of the second fan 26*b* is reduced. This makes it possible to effectively cool the parts of the fuser roller pair 14*a* corresponding to the non-paper feeding areas 30*a* and 30*b*. It is to be noted that, at step S7, control may be so performed as to stop the second fan 26*b* as shown in FIG. 8, instead of reducing the rotation speed of the second fan 26*b*.

Advisably, in a case where the shutter mechanisms 40*a* to 40*c* are provided as shown in FIG. 6, the air guide paths 31*a* to 31*c* are closed by the shutter mechanisms 40*a* to 40*c* at the start of rotation of all the fans at step S11 of FIGS. 8 and 9.

It is to be understood that the present invention may be practiced in any other manner than specifically described above as embodiments, and various modifications are possible within the scope of the invention. For example, the embodiment described above deals with a so-called central reference feeding system in which a sheet of paper is always transported through the center of the fuser roller pair 14*a* in the axis direction. However, the present invention is applicable also to a so-called one-sided reference feeding system in which a sheet of paper is transported along one edge of the fuser roller pair 14*a* in the axis direction. Advisably, in this case, since a non-paper feeding area is formed only on one side of the fuser roller pair 14*a*, there are provided two fans, one of which communicates with a paper feeding area and the other of which communicates with a non-paper feeding area, and the rotation of these two fans are individually controlled.

The descriptions heretofore deal solely with, as an image forming apparatus, a duplex-printing digital multifunction apparatus provided with a duplexer. However, needless to say, the present invention is applicable also to an image forming apparatus of any other type such as an analog copier, a tandem color image forming apparatus, a facsimile, or a laser printer.

According to the present invention, transportation of a large-sized recording medium is stabilized, thereby reducing the occurrence of wrinkles or a paper jam. Besides, in a case where more than a predetermined number of recording mediums of a size equal to or smaller than a predetermined size are transported within a predetermined time, the part corresponding to a non-paper feeding area is cooled, making it possible to even out the surface temperature of a fuser roller pair in the axis direction. This helps stabilize fusing conditions and thus makes it possible to provide an image forming apparatus that can prolong the life of the fuser roller pair.

In a case where more than a predetermined number of recording mediums of a size equal to or smaller than a predetermined size are transported within a predetermined time, by performing control in such a way that only a fan communicating with a non-paper feeding area is made to rotate, an increase in the temperature of the non-paper feeding area is effectively prevented, and, by performing control in such a way that the rotation speed of a fan communicating with a paper feeding area is reduced, it is possible to stabilize the transportation of a small-sized sheet of paper while reducing an increase in the temperature of the non-paper feeding area. Furthermore, an air guide path may be closed by using opening/closing means in transporting a recording medium that is larger than a predetermined size. Configured in this way, it is possible to reduce a reduction in the surface temperature of the fuser roller pair.

When an air outflow side of the fan communicates with a duplex-printing paper transportation path, air from the fan can be used for cooling and drying a sheet of paper passing through the duplex-printing paper transportation path and for stabilizing the transportation thereof.

What is claimed is:

1. An image forming apparatus comprising:

a transportation unit that has transfer means transferring a toner image formed on an image carrier to a recording medium, and that carries and transports the recording medium;

a fuser that fuses the toner image transferred by the transfer means to the recording medium;

a plurality of fans that are provided across a transportation width of the transportation unit for sticking the recording medium on the transportation unit onto a transporting surface by depressurizing;

an air guide path through which an air inflow side of each fan communicates with an inside of the fuser; and control means that controls a rotation of the fans in such a way that, when more than a predetermined number of recording mediums having a width equal to or smaller than a predetermined width are transported within a predetermined time, a rotation of the fan communicating through the air guide path with a paper feeding area located inside the fuser and a rotation of the fan communicating through the air guide path with a non-paper feeding area located inside the fuser are separately controlled.

2. The image forming apparatus of claim 1, wherein when more than a predetermined number of recording mediums having a width equal to or smaller than the predetermined width are transported within a predetermined time, the control means rotates only the fan communicating with the non-paper feeding area located inside the fuser.

3. The image forming apparatus of claim 1, wherein when more than a predetermined number of recording mediums having a width equal to or smaller than the predetermined width are transported within a predetermined time, the control means makes a rotation speed of the fan communicating with the paper feeding area located inside the fuser slower than a rotation speed of the fan communicating with the non-paper feeding area.

4. The image forming apparatus of claim 1, wherein there is provided opening/closing means that opens/closes the air guide path, and when a recording medium that is wider than the predetermined width is transported, the control means causes the opening/closing means to close the air guide path.

5. The image forming apparatus of claim 2, wherein there is provided opening/closing means that opens/closes the air guide path, and when a recording medium that is wider than the predetermined width is transported, the control means causes the opening/closing means to close the air guide path.

6. The image forming apparatus of claim 3, wherein there is provided opening/closing means that opens/closes the air guide path, and when a recording medium that is wider than the predetermined width is transported, the control means causes the opening/closing means to close the air guide path.

7. The image forming apparatus of claim 1, wherein there is provided a duplex-printing paper transportation path that re-transports to the transfer means a recording medium that has passed through the fuser at a time of duplex printing, and an air outflow side of each fan communicates with the duplex-printing paper transportation path.

8. The image forming apparatus of claim 2, wherein there is provided a duplex-printing paper transportation path that re-transports to the transfer means a recording medium that has passed through the fuser at a time of duplex printing, and an air outflow side of each fan communicates with the duplex-printing paper transportation path.

9. The image forming apparatus of claim 3, wherein there is provided a duplex-printing paper transportation path that re-transports to the transfer means a recording medium that has passed through the fuser at a time of duplex printing, and an air outflow side of each fan communicates with the duplex-printing paper transportation path.

10. The image forming apparatus of claim 4, wherein there is provided a duplex-printing paper transportation path that re-transports to the transfer means a recording medium that has passed through the fuser at a time of duplex printing, and an air outflow side of each fan communicates with the duplex-printing paper transportation path.

11. The image forming apparatus of claim 5, wherein there is provided a duplex-printing paper transportation path that re-transports to the transfer means a recording medium that has passed through the fuser at a time of duplex printing, and an air outflow side of each fan communicates with the duplex-printing paper transportation path.

12. The image forming apparatus of claim 6, wherein there is provided a duplex-printing paper transportation path that re-transports to the transfer means a recording medium that has passed through the fuser at a time of duplex printing, and an air outflow side of each fan communicates with the duplex-printing paper transportation path.

* * * * *